US011221574B2

(12) United States Patent
Yagi

(10) Patent No.: US 11,221,574 B2
(45) Date of Patent: Jan. 11, 2022

(54) FIXING DEVICE AND IMAGE FORMING APPARATUS

(71) Applicant: Konica Minolta, Inc., Tokyo (JP)

(72) Inventor: Masataka Yagi, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/859,997

(22) Filed: Apr. 27, 2020

(65) Prior Publication Data

US 2020/0363759 A1 Nov. 19, 2020

(30) Foreign Application Priority Data

May 13, 2019 (JP) ..... JP2019-090490

(51) Int. Cl.
*G03G 15/20* (2006.01)

(52) U.S. Cl.
CPC ..... *G03G 15/2053* (2013.01); *G03G 15/2028* (2013.01); *G03G 15/2064* (2013.01); *G03G 2215/2038* (2013.01)

(58) Field of Classification Search
CPC ..... G03G 15/2028; G03G 15/2053; G03G 15/2064; G03G 15/2057
See application file for complete search history.

(56) References Cited

U.S. PATENT DOCUMENTS

2017/0102646 A1* 4/2017 Ikebuchi ..... G03G 15/2025

FOREIGN PATENT DOCUMENTS

JP 2015-132722 A 7/2015

* cited by examiner

*Primary Examiner* — Walter L Lindsay, Jr.
*Assistant Examiner* — Andrew V Do
(74) *Attorney, Agent, or Firm* — Squire Patton Boggs (US) LLP

(57) ABSTRACT

A fixing device includes an endless fixing belt, a pad member disposed to be opposed to an inner peripheral surface of the fixing belt, a sliding contact member disposed between the fixing belt and the pad member to slide on the inner peripheral surface of the fixing belt, and a support member supporting the pad member. A heat insulating member having thermal conductivity lower than thermal conductivity of the pad member is interposed in at least one of a plurality of interfaces located between the sliding contact member in a portion in which the sliding contact member slides on the inner peripheral surface of the fixing belt and the support member.

8 Claims, 6 Drawing Sheets

FIXING DEVICE AND IMAGE FORMING APPARATUS

The entire disclosure of Japanese Patent Application No. 2019-090490, filed on May 13, 2019, is incorporated herein by reference in its entirety.

BACKGROUND

Technological Field

The present disclosure relates to a fixing device that fixes a toner image formed on a recording material such as a sheet onto the recording material and an image forming apparatus, such as a copying machine, a printer, and a facsimile, which includes the fixing device in an image forming unit that forms an image using an electrophotographic system regardless of a type such as color and monochrome.

Description of the Related Art

Generally, from the viewpoint of safety and efficiency, a heat fixing system fixing device in which the toner image is fixed onto the recording material on which the toner image is formed by applying heat and pressure to the recording material is used as a fixing device included in an electrophotographic system image forming apparatus. In the heat fixing system fixing device, the recording material on which the toner image is formed is sandwiched between a heating rotating body and a pressure rotating body, thereby fixing the toner image.

Various types of heating rotating bodies are known as the heating rotating body, and a heating rotating body using an endless fixing belt is known. The heating rotating body using the fixing belt is typically formed as a fixing belt unit in which the fixing belt, a pad member against which the fixing belt is pressed by the pressure rotating body, a support member supporting the pad member, a heat source that heating the fixing belt, and the like are assembled.

Usually, a sliding contact member that reduces frictional force generated between the fixing belt and the pad member is disposed between the fixing belt and the pad member such that the fixing belt rotates smoothly. A sliding contact sheet in which a surface of a woven fabric of a glass fiber is covered with a coat layer made of a fluororesin is typically used as the sliding contact member. For example, Japanese Laid-Open Patent Publication No. 2015-132722 discloses the fixing device in which the sliding contact member is disposed between the fixing belt and the pad member.

SUMMARY

In order to fix the toner image onto the recording material, heat of the fixing belt is transferred only to the recording material and the toner image formed on the recording material. However, the heat of the fixing belt is transferred to the pad member and the support member supporting the pad member through the sliding contact member that slides on the fixing belt.

The pad member and the support member have a large heat capacity due to structures of the pad member and the support member. In particular, the support member has the extremely large heat capacity because the support member is generally made of a steel material having high hardness For this reason, preferably the heat transfer to the pad member and the support member is prevented as much as possible in consideration of energy saving.

An object of the present disclosure is to provide a fixing device that further achieves the energy saving than before and an image forming apparatus including the fixing device.

To achieve at least one of the abovementioned objects, a fixing device reflecting one aspect of the present disclosure has the following configuration. The fixing device reflecting one aspect of the present disclosure fixes the toner image formed on a recording material to the recording material, and includes a fixing belt, a heat source, a pad member, a pressure rotating body, a sliding contact member, and support member. The fixing belt is an endless fixing belt, and the heat source is configured to heat the fixing belt. The pad member is disposed so as to be opposed to an inner peripheral surface of the fixing belt, and the pressure rotating body is disposed so as to be opposed to an outer peripheral surface of the fixing belt. The pressure rotating body is rotated while the fixing belt is pressed against the pad member, so that the pressure rotating body forms a nip in which the recording material is conveyed between the outer peripheral surface of the fixing belt and the pressure rotating body while driving the fixing belt to rotate. In the sliding contact member, at least a part of the sliding contact member is disposed between the fixing belt and the pad member such that the sliding contact member slides on the inner peripheral surface of the fixing belt in a portion corresponding to the nip. The support member supports the pad member. In the fixing device reflecting one aspect of the present disclosure, a heat insulating member having thermal conductivity lower than thermal conductivity of the pad member is interposed in at least one of a plurality of interfaces located between the sliding contact member in a portion in which the sliding contact member slides on the inner peripheral surface of the fixing belt and the support member.

To achieve at least one of the abovementioned objects, an image forming apparatus reflecting one aspect of the present disclosure includes the fixing device reflecting one aspect of the present disclosure in order to form an image.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
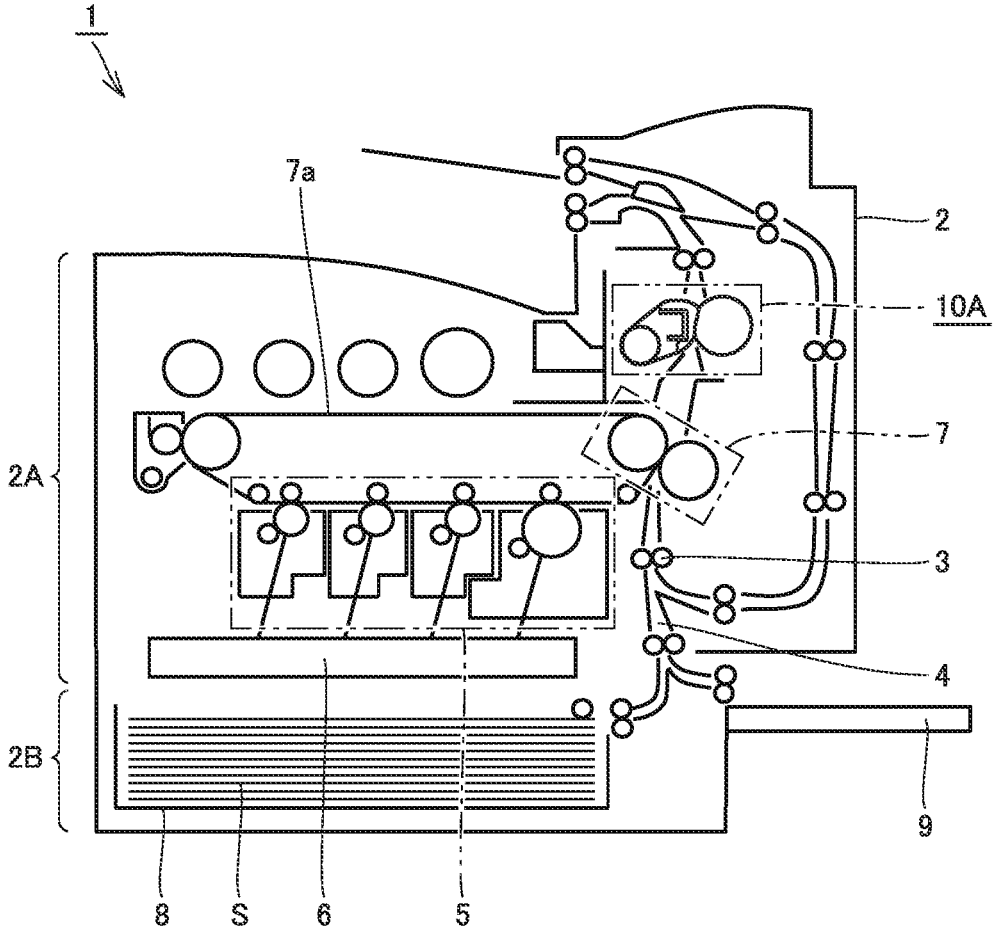
FIG. 1 is a schematic diagram illustrating an image forming apparatus according to a first embodiment.

Hereinafter, one or more embodiments of the present invention will be described with reference to the drawings. However, the scope of the invention is not limited to the disclosed embodiments.

In the following embodiments, a so-called tandem-type color printer adopting an electrophotographic system and a fixing device provided in the tandem-type color printer will be described as an example of an image forming apparatus and a fixing device to which the present invention is applied. In the following embodiments, the same or common components are denoted by the same reference numeral in the drawings, and the description will not be repeated.

First Embodiment

FIG. 1 is a schematic diagram illustrating an image forming apparatus according to a first embodiment. With reference to FIG. 1, a schematic configuration and operation of an image forming apparatus 1 of the first embodiment will be described below.

As illustrated in FIG. 1, image forming apparatus 1 mainly includes an apparatus body 2 and a sheet feeding unit 8. Apparatus body 2 includes an image forming unit 2A that is a part for forming an image on a sheet S as a recording material and a sheet feeder 2B that is a part for supplying sheet S to image forming unit 2A. Sheet feeding unit 8 stores sheet S to be supplied to image forming unit 2A, and is detachably provided in sheet feeder 2B.

In image forming apparatus 1, a plurality of rollers 3 are installed, whereby a conveyance path 4 through which sheet S is conveyed along a predetermined direction is constructed across image forming unit 2A and sheet feeder 2B. As illustrated in FIG. 1, a manual feed tray 9 for supplying sheet S to image forming unit 2A may separately be provided in apparatus body 2.

For example, image forming unit 2A mainly includes an imaging unit 5 that can form a toner image of each color of yellow (Y), magenta (M), cyan (C), and black (K), an exposure unit 6 that exposes a photoreceptor included in imaging unit 5, an intermediate transfer belt 7*a* entrained around imaging unit 5, and a transfer unit 7 provided on conveyance path 4 and on a running path of intermediate transfer belt 7*a*, and a fixing device 10A of the first embodiment, which will be described later, provided on conveyance path 4 on a downstream side of transfer unit 7.

Imaging unit 5 receives the exposure of light from exposure unit 6, forms a toner image of each color of yellow (Y), magenta (M), cyan (C) and black (K) or a toner image formed of only black (K) on a surface of the photoreceptor, and transfers the toner image to intermediate transfer belt 7*a* (so-called primary transfer). Consequently, a color toner image or a monochrome toner image is formed on intermediate transfer belt 7*a*.

Intermediate transfer belt 7*a* transports the color toner image or the monochrome toner image formed on the surface of intermediate transfer belt 7*a* to transfer unit 7, and is pressed by transfer unit 7 together with sheet S conveyed from sheet feeder 2B to transfer unit 7. Consequently, the color toner image or the monochrome toner image formed on the surface of intermediate transfer belt 7*a* is transferred to sheet S (so-called secondary transfer).

Then, sheet S on which the color toner image or the monochrome toner image is transferred is pressurized and heated by fixing device 10A. Consequently, a color image or a monochrome image is formed on sheet S, and sheet S on which the color image or the monochrome image is formed is discharged from apparatus body 2.

Figure 2:
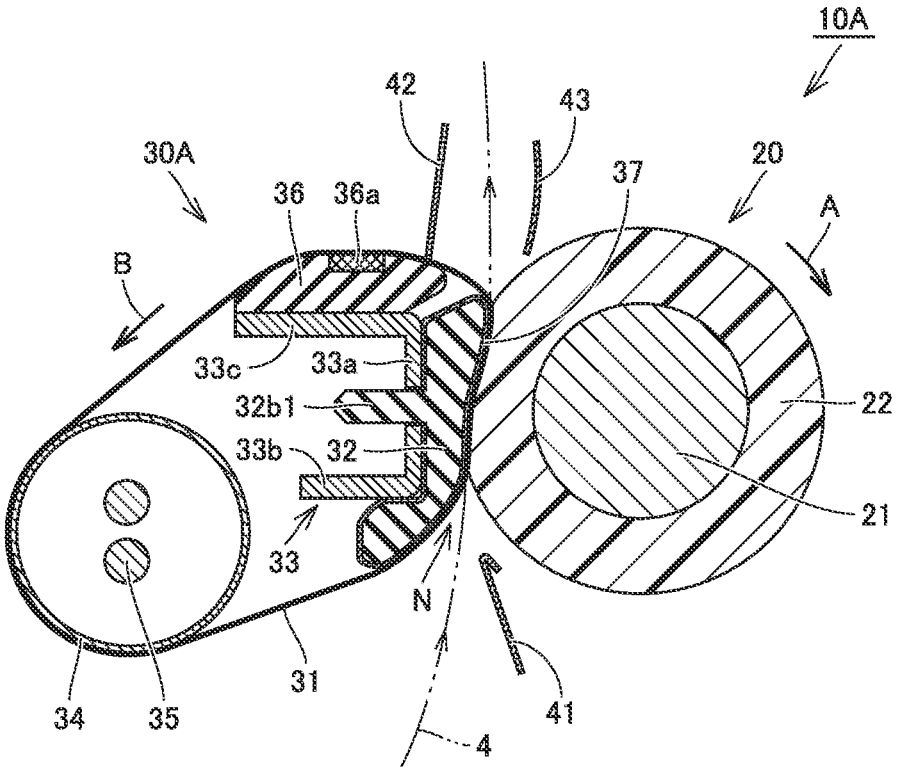
FIG. 2 is a schematic sectional view illustrating a fixing device of the first embodiment.

FIG. 2 is a schematic sectional view illustrating the fixing device of the first embodiment. With reference to FIG. 2, the configuration and operation of fixing device 10A of the first embodiment will be described below.

As illustrated in FIG. 2, fixing device 10A mainly includes a pressure roller 20 as the pressure rotating body, a fixing belt unit 30A as the heating rotating body including a fixing belt 31, and various guides 41 to 43 that guides the conveyance of sheet S.

Pressure roller 20 includes a core metal 21 made of metal such as an aluminum alloy, steel, or the like and a rubber elastic layer 22 that is provided to cover core metal 21 and made of silicone rubber, fluorine rubber, or the like. Pressure roller 20 may further include a release layer that is provided to cover elastic layer 22 and is made of a fluorine-based resin or the like.

Core metal 21 may have various shapes such as a solid columnar shape or a cylindrical shape. An outer diameter of core metal 21 is not particularly limited. For example, the outer diameter is greater than or equal to 20 mm and less than or equal to 100 mm. A thickness of elastic layer 22 and a thickness of the release layer are not particularly limited. For example, the thickness of elastic layer 22 is greater than or equal to 1 mm and less than or equal to 20 mm, and the thickness of the release layer is greater than or equal to 5 μm and less than or equal to 100 μm.

Pressure roller 20 is disposed so as to be opposed to an outer peripheral surface of fixing belt 31, and both ends in an axial direction of pressure roller 20 are rotatably journaled by a shaft support (not illustrated). Pressure roller 20 is rotated by a drive source such as a motor (not illustrated). Pressure roller 20 is configured to be elastically biased toward fixing belt unit 30A by a biasing member (not illustrated).

Fixing belt unit 30A mainly includes a pressure pad 32 as a pad member, a support member 33, a heating roller 34, a heat source 35, an auxiliary pad 36, and a laminated sheet 37 in addition to fixing belt 31.

Fixing belt 31 has an endless shape, and is made of, for example, a plurality of layers in consideration of a heat-resisting property, strength, surface smoothness, and the like. Specifically, fixing belt 31 includes a base material layer made of a polyimide resin, a stainless steel alloy, nickel electroforming, or the like, a rubber elastic layer made of silicone rubber, fluorine rubber, or the like, and a release layer made of a fluorine resin or the like. In the plurality of layers, the base material layer, the elastic layer, and the release layer are located in order from an inside to an outside of fixing belt 31.

A peripheral length of fixing belt 31 is not particularly limited. For example, the outer diameter of fixing belt 31 is greater than or equal to 10 mm and less than or equal to 100 mm. The thickness of the base material layer, the thickness of the elastic layer, and the thickness of the release layer are not particularly limited. For example, the thickness of the base material layer is greater than or equal to 5 μm and less than or equal to 100 μm, the thickness of the elastic layer is greater than or equal to 10 μm and less than or equal to 300 μm, and the thickness of the release layer is greater than or equal to 5 μm and less than or equal to 100 μm.

Pressure pad 32 is formed of a long plate-shaped member extending along a width direction (that is, the axial direction of pressure roller 20) of fixing belt 31, and disposed in a space inside fixing belt 31. Consequently, pressure pad 32 faces the inner peripheral surface of fixing belt 31 so as to be opposed to pressure roller 20 with fixing belt 31 interposed therebetween.

For example, pressure pad 32 is formed of a resin member made of a liquid crystal polymer resin, a polyphenylene sulfide resin, or a polyimide resin or a metal member made of an aluminum alloy or steel. In the first embodiment, pressure pad 32 is made of a liquid crystal polymer.

Laminated sheet 37 is attached to the surface of pressure pad 32. More specifically, laminated sheet 37 includes a sliding contact sheet 37*a* as a sliding contact member and a heat insulating sheet 37*b* as a heat insulating member (see FIG. 3 or 4), and a predetermined part on the surface of pressure pad 32 is covered with sliding contact sheet 37*a* and heat insulating sheet 37*b*. A specific configuration, function, and the like of laminated sheet 37 formed of sliding contact sheet 37*a* and heat insulating sheet 37*b* will be described in detail later.

Support member 33 is formed of a long plate-like member extending along the width direction of fixing belt 31, and disposed in a space inside fixing belt 31 so as to be located on a side opposite to a side on which pressure roller 20 is located as viewed from pressure pad 32. Support member 33 reinforces pressure pad 32 while supporting pressure pad 32.

Support member 33 has a substantially C-shaped section including a flat base 33*a* opposed to pressure pad 32 and a pair of flat standing walls (the standing wall includes an upstream-side standing wall 33*b* and a downstream-side standing wall 33*c*) provided upright from base 33*a* toward the side opposite to the side on which pressure roller 20 is located.

Upstream-side standing wall 33*b* that is one of the pair of standing walls is provided upright from base 33*a* at an upstream position (that is, a lower position in FIG. 2) in a conveyance direction of sheet S, and downstream-side standing wall 33*c* that is the other of the pair of standing walls is provided upright from base 33*a* at a downstream position (that is, an upper position in FIG. 2) in the conveyance direction of sheet S.

For example, support member 33 is made of a metal member such as an electrogalvanized steel sheet (SECC). Both ends in the width direction of support member 33 are supported by a chassis (not illustrated), whereby support member 33 fixed to the chassis. A hook-shaped latching claw (not illustrated) provided around pressure pad 32 is latched in a periphery of base 33*a* of support member 33, whereby pressure pad 32 is assembled while pressure pad 32 is lightly held by support member 33.

Heating roller 34 is formed of a cylindrical member extending along the width direction of fixing belt 31, and disposed in a space inside fixing belt 31 so as to be located on a side opposite to a side on which pressure roller 20 is located as viewed from support member 33. Consequently, the outer peripheral surface of heating roller 34 faces the inner peripheral surface of fixing belt 31. Heat roller 34 transfers heat generated by heating source 35 to fixing belt 31. In heating roller 34, both ends in the axial direction of heating roller 34 are rotatably journaled by a shaft support (not illustrated).

For example, heating roller 34 is formed of a metal cylindrical member made of an aluminum alloy. The outer diameter of heating roller 34 is not particularly limited. For example, the outer diameter is greater than or equal to 10 mm and less than or equal to 100 mm. Preferably, the inner peripheral surface of heating roller 34 is covered with a black layer in order to efficiently transfer the heat, and the outer peripheral surface of heating roller 34 is covered with a protective layer made of fluororesin or the like.

Heat source 35 includes a long heater and a short heater, which are a pair of rod-shaped heaters extending along a direction parallel to the width direction of fixing belt 31, and heat source 35 is disposed in a space inside heating roller 34. Heat source 35 heats fixing belt 31 through heating roller 34, and both ends in the axial direction of heat source 35 are held by a holder (not illustrated). For example, each of the long heater and the short heater is formed of a halogen heater.

The long heater has a heat generator in a region corresponding to substantially the whole region in the width direction of fixing belt 31, and the heat generator mainly generates heat to heat fixing belt 31 through heating roller 34 by radiant heat. The axial length of the heat generator corresponds to the width of the sheet having the maximum width in sheets of various sizes supplied to image forming apparatus 1.

The short heater includes a heat generator only in a region corresponding to a central portion in the width direction of fixing belt 31, and the heat generator mainly generates heat to heat fixing belt 31 through heating roller 34 by the radiant heat. The axial length of the heat generator corresponds to the width of the sheet having the minimum width in sheets of various sizes supplied to image forming apparatus 1.

In addition to the halogen heater, an IH (electromagnetic induction heating) type heat source or the like can be used as heat source 35, and heating roller 34 or fixing belt 31 formed of a resistance heating element can be used as the heat source.

Auxiliary pad 36 is formed of a long plate-like member extending along the width direction of fixing belt 31, and is fixed to the outside surface of the downstream-side standing wall 33*c* provided on support member 33 so as to be disposed in the space inside fixing belt 31. Auxiliary pad 36 is a guide that guides fixing belt 31, and applies a lubricant to the inner peripheral surface of fixing belt 31.

More specifically, auxiliary pad 36 is provided at a downstream position of a nip N (to be described later) in the rotation direction of fixing belt 31, and includes a lubricant supply unit 36*a* as an application unit. For example, lubricant supply section 36*a* is made of felt impregnated with a lubricant such as grease, and the lubricant is supplied to the inner peripheral surface of fixing belt 31 by abutting the inner peripheral surface of fixing belt 31 onto lubricant supply section 36*a*. Consequently, slidability between fixing belt 31 and pressure pad 32 (more strictly, slidability between fixing belt 31 and sliding contact sheet 37*a*) is improved.

At this point, as described above, pressure roller 20 is configured to be elastically biased toward the side of fixing belt unit 30A by the biasing member (not illustrated). For this reason, pressure roller 20 is elastically biased in the direction in which pressure roller 20 approaches fixing belt 31 by the biasing force of the biasing member, whereby fixing belt 31 is pressed against pressure pad 32 by pressure roller 20. Consequently, a pressing state in which pressure pad 32 is pressed by pressure roller 20 is obtained.

On the other hand, fixing belt 31 is entrained around pressure pad 32, heating roller 34, and auxiliary pad 36. Fixing belt 31 can rotate so as to slide on a main surface of pressure pad 32 on the side of pressure roller 20 (more strictly, on laminated sheet 37 in a portion covering the main surface of pressure pad 32). Due to this rotation, a portion of fixing belt 31 that is in contact with heating roller 34 is heated by heat source 35. Then, the portion of fixing belt 31 moves to nip N (to be described later), and the sheet S supplied to nip N and the toner image formed on sheet S are heated by the portion of fixing belt 31.

That is, in fixing device 10A of the first embodiment, as described above, pressure roller 20 is rotated in a direction of an arrow A in FIG. 2 by a drive source (not illustrated) while pressure roller 20 is biased toward the side of fixing belt unit 30A, whereby fixing belt 31 is driven to rotate in a direction of an arrow B in FIG. 2 so as to slide on pressure pad 32.

Consequently, nip N in which sheet S is conveyed is formed between pressure roller 20 and pressure pad 32 (more precisely, between pressure roller 20 and the outer peripheral surface of fixing belt 31). In other words, pressure roller 20 and fixing belt unit 30A are disposed so as to sandwich conveyance path 4 such that nip N formed between pressure roller 20 and fixing belt unit 30A is located on conveyance path 4 of the sheet.

An entrance-side guide 41 is provided at a position on conveyance path 4 and at a position on the upstream side of nip N along the conveyance direction of sheet S (that is, a lower position in FIG. 2). Entrance-side guide 41 is a guide that reliably inputs sheet S conveyed on conveyance path 4 to nip N.

A separation guide 42 and an exit-side guide 43 is provided at a position on conveyance path 4 at a position on the downstream side of nip N along the conveyance direction of sheet S (that is, an upper position in FIG. 2). The separation guide 42 is a guide that separates sheet S that is in close contact with fixing belt 31 when sheet S is discharged from nip N from fixing belt 31, and exit-side guide 43 is a guide that reliably returns sheet S separated from fixing belt 31 by separation guide 42 onto conveyance path 4.

With the above configuration, in fixing device 10A of the first embodiment, during the fixing operation (that is, in the pressed state), the toner image formed on sheet S is heated and pressurized in nip N, whereby the toner image is fixed onto sheet S.

Figure 3:
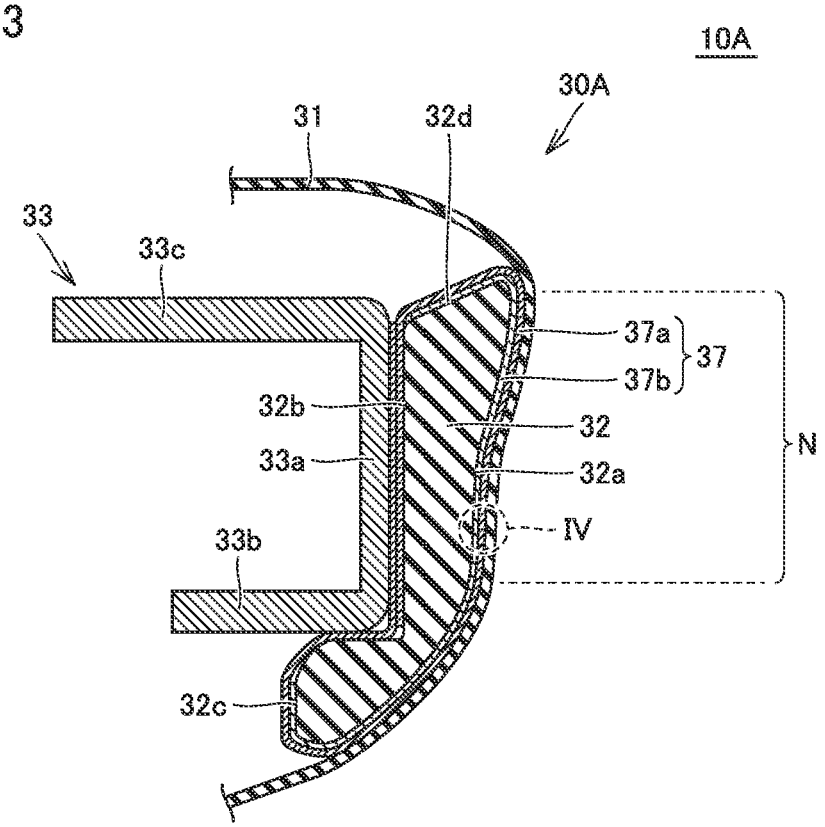
FIG. 3 is a sectional view illustrating a detailed structure near a pressure pad of the fixing device of the first embodiment.
Figure 4:
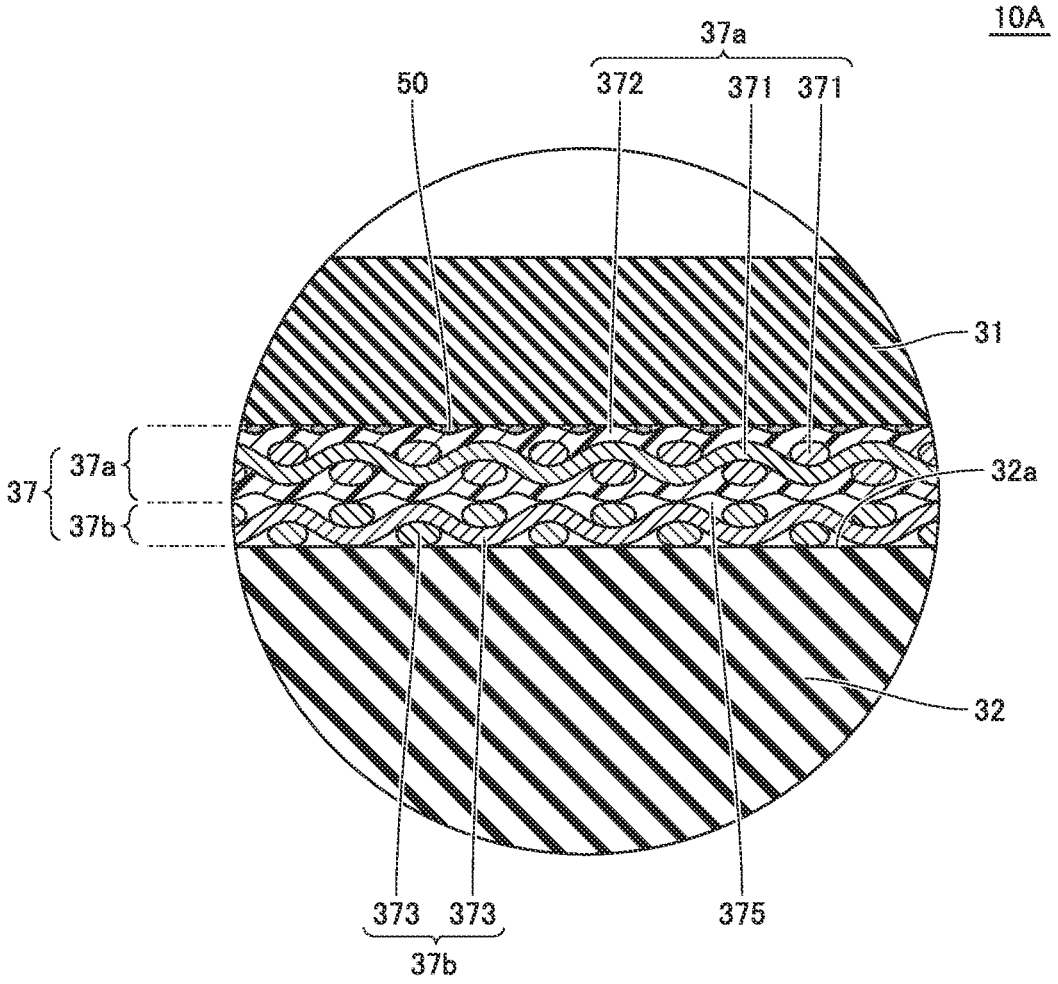
FIG. 4 is a schematic enlarged sectional view near a heat insulating sheet of the fixing device of the first embodiment.

FIG. 3 is a sectional view illustrating a detailed structure near the pressure pad of the fixing device of the first embodiment, and FIG. 4 is a schematic enlarged view of a region IV in FIG. 3 (that is, a schematic enlarged view near the heat insulating sheet). With reference to FIGS. 3 and 4, a detailed structure near pressure pad 32 of fixing device 10A of the first embodiment will be described below.

As illustrated in FIG. 3, pressure pad 32 includes a first main surface 32*a* located on the side of pressure roller 20 (that is, the conveyance path 4 side of sheet S) as viewed from pressure pad 32, a second main surface 32*b* located on the support member 33 side as viewed from pressure pad 32, and a third main surface 32*c* located on the upstream side of conveyance path 4 of sheet S to connect first main surface 32*a* and second main surface 32*b*, and a fourth main surface 32*d* located on the downstream side of conveyance path 4 of sheet S to connect first main surface 32*a* and second main surface 32*b*. First main surface 32*a*, second main surface 32*b*, third main surface 32*c*, and fourth main surface 32*d* extend along a longitudinal direction of pressure pad 32 (that is, the direction parallel to the axial direction of pressure roller 20).

Among the main surfaces, first main surface 32*a* is formed of a curved surface that is smoothly curved along the rotation direction of fixing belt 31, and first main surface 32*a* includes a portion facing fixing belt 31 in a portion corresponding to nip N through laminated sheet 37.

Laminated sheet 37 includes sliding contact sheet 37*a* and heat insulating sheet 37*b* as described above. Sliding contact sheet 37*a* and heat insulating sheet 37*b* are laminated so as to overlap each other in a thickness direction, thereby forming laminated sheet 37. Laminated sheet 37 is provided so as to cover first main surface 32*a*, second main surface 32*b*, third main surface 32*c*, and fourth main surface 32*d* of pressure pad 32, and is located so as to surround pressure pad 32.

More specifically, sliding contact sheet 37*a* includes a portion covering first main surface 32*a*, second main surface 32*b*, third main surface 32*c*, and fourth main surface 32*d* of pressure pad 32, and heat insulating sheet 37*b* includes a portion covering first main surface 32*a*, third main surface 32*c*, and fourth main surface 32*d* of pressure pad 32. Heat insulating sheet 37*b* is interposed between sliding contact sheet 37*a* and pressure pad 32, and a front surface and a back surface of heat insulating sheet 37*b* contact with sliding contact sheet 37*a* and pressure pad 32, respectively.

At this point, in sliding contact sheet 37*a*, a pair of ends of sliding contact sheet 37*a* located in a direction orthogonal to the longitudinal direction of pressure pad 32 are wound around pressure pad 32 so as to overlap each other on second main surface 32*b* of pressure pad 32, and sliding contact sheet 37*a* in a portion covering second main surface 32*b* of pressure pad 32 is held by pressure pad 32 and support member 33 while sandwiched between pressure pad 32 and support member 33.

With this configuration, in fixing device 10A of the first embodiment, heat insulating sheet 37*b* is interposed between sliding contact sheet 37*a* in the portion in which sliding contact sheet 37*a* slides on the inner peripheral surface of fixing belt 31 and pressure pad 32 in a plurality of interfaces located between sliding contact sheet 37*a* in the portion in which sliding contact sheet 37*a* slides on the inner peripheral surface of fixing belt 31 and support member 33. Consequently, the transfer of the heat of fixing belt 31 to pressure pad 32 and support member 33 can effectively be prevented by heat insulating sheet 37*b* disposed in the portion. The details will be described later.

A method for fixing laminated sheet 37 to pressure pad 32 is not particularly limited, but bonding using an adhesive, latching using a latching unit, or the like can be adopted.

In fixing device 10A of the first embodiment, as illustrated in FIG. 2, a latching pin 32*b*1 is provided on second main surface 32*b* of pressure pad 32, a latching hole into which latching pin 32*b*1 can be inserted is provided in support member 33, and a through-hole into which latching pin 32*b*1 can be inserted is made at a position near each of the pair of ends of laminated sheet 37. Latching pins 32*b*1 are further inserted into the latching holes while inserted into each of the through-holes provided in laminated sheet 37, whereby laminated sheet 37 is fixed to pressure pad 32 while sandwiched between pressure pad 32 and support member 33.

Sliding contact sheet 37*a* and heat insulating sheet 37*b* may be bonded together, or may simply overlap each other. However, in order to effectively exert a heat insulating function of heat insulating sheet 37*b* (to be described later), it is not preferable to bond sliding contact sheet 37*a* and heat insulating sheet 37*b* over the whole contact surface, but it is preferable that sliding contact sheet 37*a* and heat insulating sheet 37*b* be partially bonded or simply overlap each other.

Sliding contact sheet 37*a* and pressure pad 32 may be bonded together or may simply overlap each other. However, in order to more effectively exert the heat insulating function of heat insulating sheet 37*b*, it is not preferable to bond sliding contact sheet 37*a* and pressure pad 32 over the whole contact surface, but it is preferable that sliding contact sheet 37*a* and pressure pad 32 be partially bonded or simply overlap each other.

As illustrated in FIGS. 3 and 4, in fixing device 10A of the first embodiment having the above configuration, fixing belt 31, sliding contact sheet 37*a*, heat insulating sheet 37*b*, pressure pad 32, sliding contact sheet 37*a*, and support member 33 are disposed in this order from the pressure roller 20 side (that is, the right side in FIG. 3, the upper side in FIG. 4) while laminated with each other.

As illustrated in FIG. 4, a sheet in which the surface of a woven fabric of a glass fiber 371 as the base material is covered with a coating layer 372 made of a fluororesin is used as sliding contact sheet 37*a*. In sliding contact sheet 37*a*, the contact surface with fixing belt 31 is made of a fluorine-based resin in which frictional resistance is hardly generated, thereby improving the slidability of fixing belt 31. Because sliding contact sheet 37*a* has minute irregularities on the contact surface with fixing belt 31, sliding contact sheet 37*a* is held while a lubricant 50 adhering to the inner peripheral surface of fixing belt 31 (that is, the contact surface with sliding contact sheet 37*a*) enters a recess of sliding contact sheet 37*a*, which allows the slidability of fixing belt 31 to be further improved.

On the other hand, a woven fabric of a glass fiber 373 is used as heat insulating sheet 37*b*. Heat insulating sheet 37*b* is made of the same kind of material as the base material of sliding contact sheet 37*a*. However, heat insulating sheet 37*b* does not include a special coat layer on the surface of heat insulating sheet 37*b*, and therefore heat insulating sheet 37*b* has many voids 375 on the surface and the inside of heat insulating sheet 37*b*. Due to the presence of the void, heat insulating sheet 37*b* exhibits high heat insulating performance.

At this point, a sheet in which thermal conductivity $\lambda$ is sufficiently smaller than thermal conductivity $\lambda_p$ of pressure pad 32 is used as heat insulating sheet 37*b*. In the first embodiment, as described above, pressure pad 32 is made of a liquid crystal polymer, and pressure pad 32 has thermal conductivity $\lambda_p$ of about 0.6 W/m·K. On the other hand, heat insulating sheet 37*b* made of the woven fabric of glass fiber 373 has thermal conductivity $\lambda$ of about 0.04 W/m·K or less.

As described above, the transfer of the heat of fixing belt 31 to pressure pad 32 and support member 33 can effectively be prevented using heat insulating sheet 37*b* in which thermal conductivity $\lambda$ is sufficiently smaller than thermal conductivity $\lambda_p$ of pressure pad 32.

Preferably, a sheet in which thermal conductivity $\lambda$ is sufficiently smaller than thermal conductivity $\lambda_s$ of sliding contact sheet 37*a* is used as heat insulating sheet 37*b*. In the first embodiment, as described above, sliding contact sheet 37*a* is formed by covering the surface of the woven fabric of glass fiber 371 as the base material with coating layer 372 made of a fluororesin, and sliding contact sheet 37*a* has thermal conductivity $\lambda_s$ of about 0.1 W/m·K that is larger than thermal conductivity $\lambda$ of heat insulating sheet 37*b*.

In this way, the transfer of the heat of fixing belt 31 to pressure pad 32 and support member 33 can more effectively be prevented using heat insulating sheet 37*b* in which thermal conductivity $\lambda$ is smaller than thermal conductivity $\lambda_s$ of sliding contact sheet 37*a*.

From the viewpoint of preventing the heat transfer from the fixing belt to the pressure pad and the support member, it is considered that instead of providing the heat insulating sheet as described above, the thickness of the sliding contact sheet may be increased or the pressure pad itself may be made of a member having a small thermal conductivity.

However, when the glass fiber is thickened to increase the thickness of the sliding contact sheet, surface roughness of the sliding contact sheet becomes too large, which results in generation of unevenness in the fixed image. When the thickness of the coating layer is increased to increase the thickness of the sliding contact sheet, the surface roughness of the sliding contact sheet becomes too small, which results in a problem in that the slidability of the fixing belt is degraded or the thermal conductivity of the sliding contact sheet itself increases.

On the other hand, when glass beads or the like are mixed in the base material such as a liquid crystal polymer so that the pressure pad itself is made of a member having a low thermal conductivity, a considerable shortage of strength is generated. When the thickness is increased to compensate for the shortage of strength, heat capacity increases as a result.

Thus, in fixing device 10A of the first embodiment and image forming apparatus 1 including fixing device 10A, the transfer of the heat of fixing belt 31 to pressure pad 32 and support member 33 can effectively be prevented without generating the problem, and energy saving can be further achieved than before.

Figure 5:
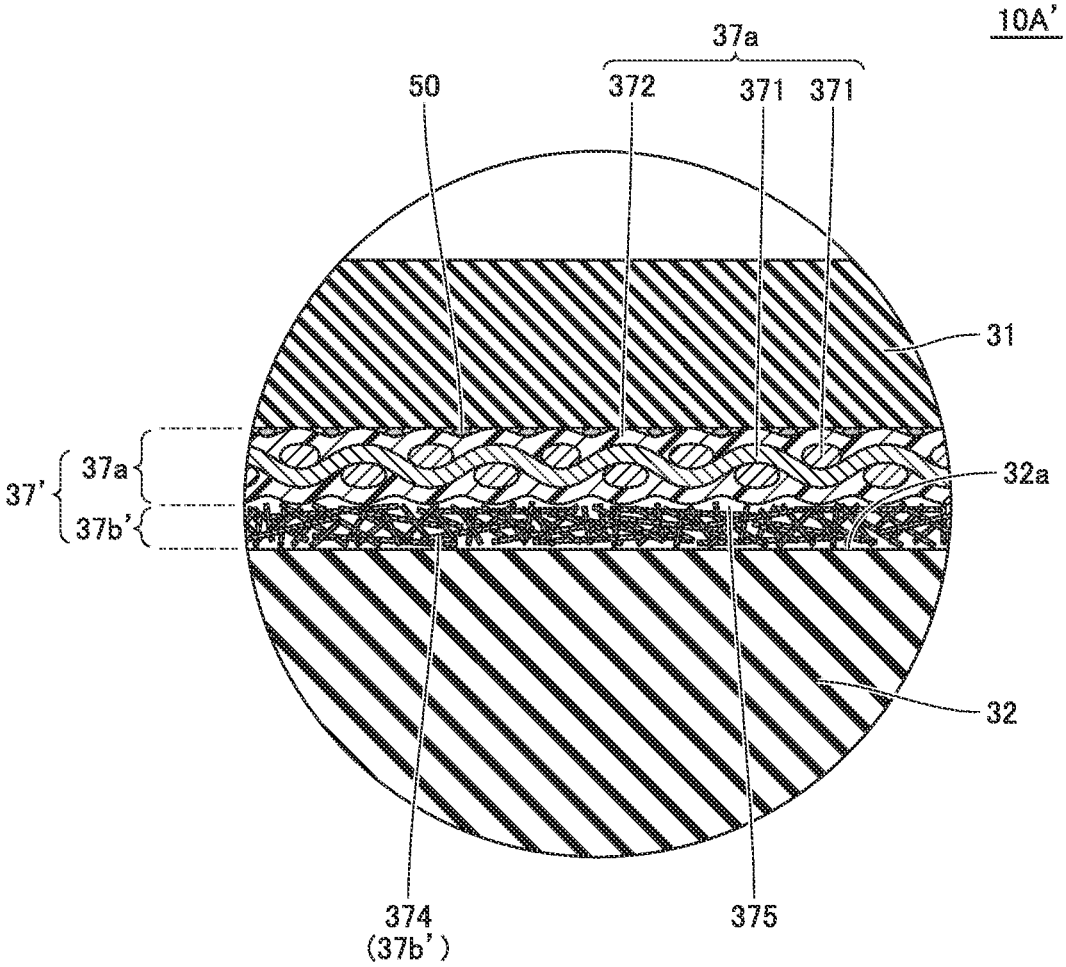
FIG. 5 is a schematic enlarged sectional view near a heat insulating sheet of a fixing device according to a modification.

FIG. 5 is a schematic enlarged sectional view near a heat insulating sheet of a fixing device according to a modification; With reference to FIG. 5, a fixing device 10A' according to a modification will be described in detail below.

As illustrated in FIG. 5, a laminated sheet 37' in which sliding contact sheet 37*a* whose surface of the woven fabric of glass fiber 371 as the base material is covered with coating layer 372 made of the fluororesin (that is, the same sheet as sliding contact sheet 37*a* of fixing device 10A) and a heat insulating sheet 37*b*' made of a nonwoven fabric of a glass fiber 374 are laminated is used in fixing device 10A' of the modification.

As compared with heat insulating sheet 37*b* made of the woven fabric of glass fiber 373, although heat insulating sheet 37*b*' made of the nonwoven fabric of glass fiber 374 has a characteristic that is weaker against tensile force and shearing force, heat insulating sheet 37*b*' exerts higher thermal insulation because more voids 375 are included on the surface and the inside heat insulating sheet 37*b*', and has thermal conductivity $\lambda$ of about 0.03 W/m·K or less.

For this reason, heat insulating sheet 37*b*' is fixed to pressure pad 32 by adopting the fixing method in which only compressive force acts on heat insulating sheet 37*b*' without applying tensile force or shearing force to heat insulating sheet 37*b*' (for example, by bonding heat insulating sheet 37*b*' to pressure pad 32 using a double-sided tape over the whole region of the main surface on the pressure pad 32 side), thereby exerting higher heat insulation performance. Thus, when the configuration is adopted, the energy saving can more efficiently be achieved.

A heat insulating member made of another material can be used instead of the heat insulating member made of the inorganic fiber material such as the woven or nonwoven fabric of the glass fiber as described above. However, only the heat insulating property but also mechanical strength, incompressibility, free deformability, and the like are sufficiently satisfied as a heat insulating member preventing the heat of the fixing belt from being transferred to the pressure pad and the support member in the fixing device.

The heat-resisting property is a requirement required for necessity not to deform or denature the heat insulating member even if the fixing belt receives the heat because the fixing belt is heated to a very high temperature, and the mechanical strength is a requirement required for necessity not to damage the heat insulating member in association with plastic deformation of the heat insulating member even if the pressure is applied because the pressure of the pressure roller is extremely large.

The incompressibility is a requirement required for necessity not to excessively compress and deform the heat insulating member by receiving pressing force from the pressure roller. This is because, when the heat insulating member is excessively compressed and deformed, a part of the heat insulating member enters the irregularities of the surface of the sliding contact member, consequently, the number of voids formed between the sliding contact member and the heat insulating member is significantly decreased, and therefore the heat insulating property is significantly degraded.

The free deformability is a requirement required for necessity to dispose the heat insulating member along a curved surface while the curved surface is allocated to the first main surface that is the surface of the pressure pad located on the nip side because the first main surface is formed of the curved surface as described above, and required for necessity to prevent the damage by the flexible and free deformation of the heat insulating member even when the pressing force of the pressure roller is applied.

At this point, the reason why the first main surface of the pressure pad is formed of the curved surface is to improve quality of a fixed image. That is, in order to obtain the good-quality fixed image, it is necessary to appropriately control a pressure distribution of the nip along the sheet conveyance direction. Specifically, in the pressure distribution of the nip along the sheet conveyance direction, desirably the pressure is relatively small at the entrance-side portion of the nip and the pressure is relatively large at the exit-side portion of the nip. This is because, during the fixing of the toner image, the toner adhering to the surface of the sheet is sufficiently melted in the entrance-side portion of the nip, and then the melted toner is pressed against the sheet at a higher pressure in the exit-side portion of the nip, which allows the high-quality image to be obtained.

For this reason, the first main surface of the pressure pad is formed of the curved surface as described above such that the pressure is relatively small at the entrance-side portion of the nip while the pressure is relatively large at the exit-side portion of the nip.

Examples of a material generally used for the heat insulating member include, in addition to the inorganic fiber materials as described above, inorganic non-fiber materials such as gypsum and a ceramic material, foam resin materials such as polyethylene foam, foamed rubber materials such as silicone sponge, and organic fiber materials such as paper and a polyimide fiber.

The inorganic non-fibrous materials such as the gypsum and the ceramic material sufficiently satisfy the requirement in terms of the heat-resisting property, the mechanical strength, and the incompressibility, but insufficiently satisfy the requirement in terms of the free deformability. However, the inorganic non-fibrous materials are not necessarily suitable to the material for the heat insulating member used in the fixing device.

In addition, the foam resin materials such as the polyethylene foam sufficiently satisfy the requirement in terms of the mechanical strength and the free deformability, but insufficiently satisfy the requirement in terms of the heat-resisting property and the incompressibility. However, the foam resin materials are not necessarily suitable to the material of the heat insulating member used in the fixing device.

The foamed rubber materials such as the silicone sponge sufficiently satisfy the requirement in terms of the heat-resisting property, the mechanical strength, the incompressibility, and the free deformability, but insufficiently satisfy the requirement in terms of the incompressibility. However, the foamed resin materials are not necessarily suitable to the material for the heat insulating member used in the fixing device.

On the other hand, the inorganic fiber materials as described above and the organic fiber materials such as the paper and the polyimide fiber sufficiently satisfy the heat-resisting property, the mechanically strength, the incompressibility, and the freely deformability, and it can be said that the inorganic fiber materials and the organic fiber materials are particularly suitable to the material for the heat insulating member used in the fixing device.

Thus, in addition to the inorganic fiber material as described above, an organic fiber material such as paper, polyimide fiber, or the like can suitably be used as the material for the heat insulating member used in the fixing device.

Second Embodiment

Figure 6:
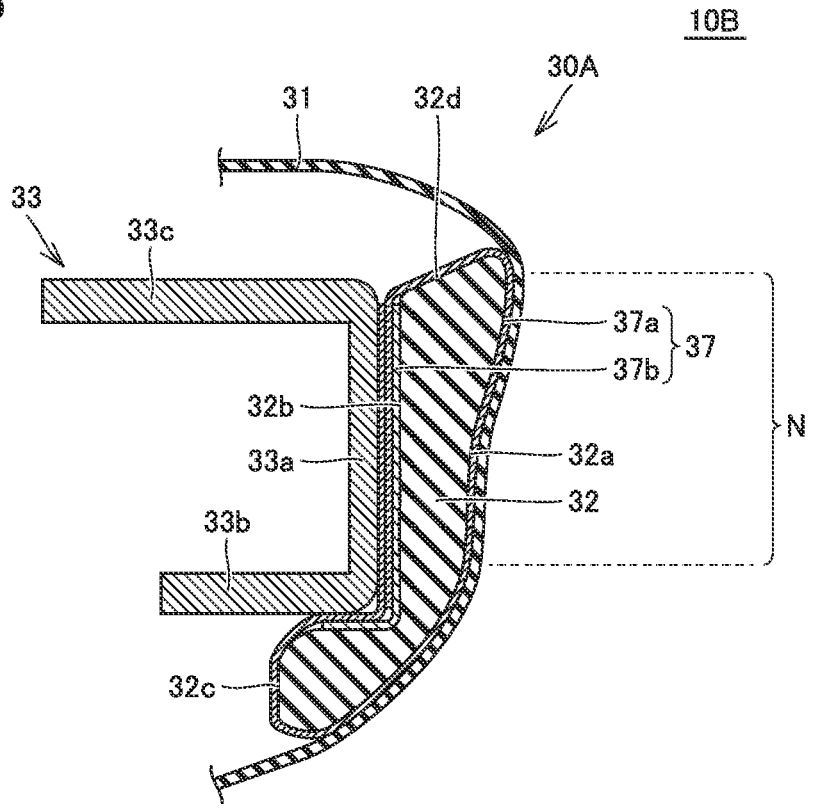
FIG. 6 is a sectional view illustrating a detailed structure near a pressure pad of a fixing device according to the second embodiment.

FIG. 6 is a sectional view illustrating a detailed structure near a pressure pad of a fixing device according to the second embodiment. With reference to FIG. 6, a fixing device 10B of the second embodiment will be described below. Instead of fixing device 10A of the first embodiment, fixing device 10B of the second embodiment is included in image forming apparatus 1.

As illustrated in FIG. 6, in fixing device 10B of the second embodiment, laminated sheet 37 includes sliding contact sheet 37*a* and heat insulating sheet 37*b*, and is located so as to surround pressure pad 32.

More specifically, sliding contact sheet 37*a* includes the portion covering first main surface 32*a*, second main surface 32*b*, third main surface 32*c*, and fourth main surface 32*d* of pressure pad 32, and heat insulating sheet 37*b* includes the portion covering second main surface 32*b* of pressure pad 32. Heat insulating sheet 37*b* is interposed between pressure pad 32 and sliding contact sheet 37*a*, and the front surface and the back surface of heat insulating sheet 37*b* contact with pressure pad 32 and sliding contact sheet 37*a*, respectively.

With this configuration, in fixing device 10B of the second embodiment, heat insulating sheet 37*b* is interposed between pressure pad 32 and support member 33 in the portion in which sliding contact sheet 37*a* slides on the inner peripheral surface of fixing belt 31 in a plurality of interfaces located between sliding contact sheet 37*a* in a portion in which sliding contact sheet 37*a* slides on the inner peripheral surface of fixing belt 31 and support member 33. Consequently, the further transfer of the heat transferred from fixing belt 31 to pressure pad 32 to support member 33 can effectively be prevented by heat insulating sheet 37*b* disposed in the portion.

Thus, in fixing device 10B of the second embodiment and image forming apparatus 1 including fixing device 10B, the transfer of the heat of fixing belt 31 to support member 33 can effectively be prevented, and the energy saving can be further achieved than before.

Third Embodiment

Figure 7:
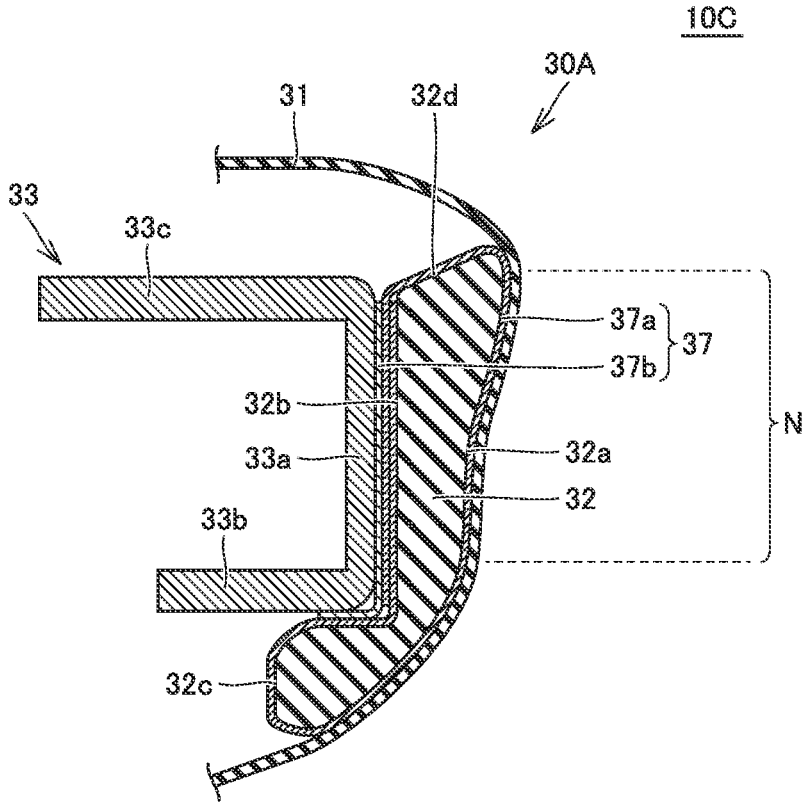
FIG. 7 is a sectional view illustrating a detailed structure near a pressure pad of a fixing device according to a third embodiment.

FIG. 7 is a sectional view illustrating a detailed structure near a pressure pad of a fixing device according to a third embodiment. With reference to FIG. 7, a fixing device 10C of the third embodiment will be described below. Instead of fixing device 10A of the first embodiment, fixing device 10C of the third embodiment is included in image forming apparatus 1.

As illustrated in FIG. 7, in fixing device 10C of the third embodiment, laminated sheet 37 includes sliding contact sheet 37*a* and heat insulating sheet 37*b*, and is located so as to surround pressure pad 32.

More specifically, sliding contact sheet 37*a* includes the portion covering first main surface 32*a*, second main surface 32*b*, third main surface 32*c*, and fourth main surface 32*d* of pressure pad 32, and heat insulating sheet 37*b* includes the portion covering second main surface 32*b* of pressure pad 32. Heat insulating sheet 37*b* is interposed between sliding contact sheet 37*a* and support member 33, and the front surface and the back surface of heat insulating sheet 37*b* contact with sliding contact sheet 37*a* and support member 33, respectively.

With this configuration, in fixing device 10C of the third embodiment, heat insulating sheet 37*b* is interposed between pressure pad 32 and support member 33 in a plurality of interfaces located between sliding contact sheet 37*a* in the portion in which sliding contact sheet 37*a* slides on the inner peripheral surface of fixing belt 31 and support member 33. Consequently, the further transfer of the heat transferred from fixing belt 31 to pressure pad 32 to support member 33 can effectively be prevented by heat insulating sheet 37*b* disposed in the portion.

Thus, in fixing device 10C of the third embodiment and image forming apparatus 1 including fixing device 10C, the transfer of the heat of fixing belt 31 to support member 33 can effectively be prevented, and the energy saving can be further achieved than before.

Fourth Embodiment

Figure 8:
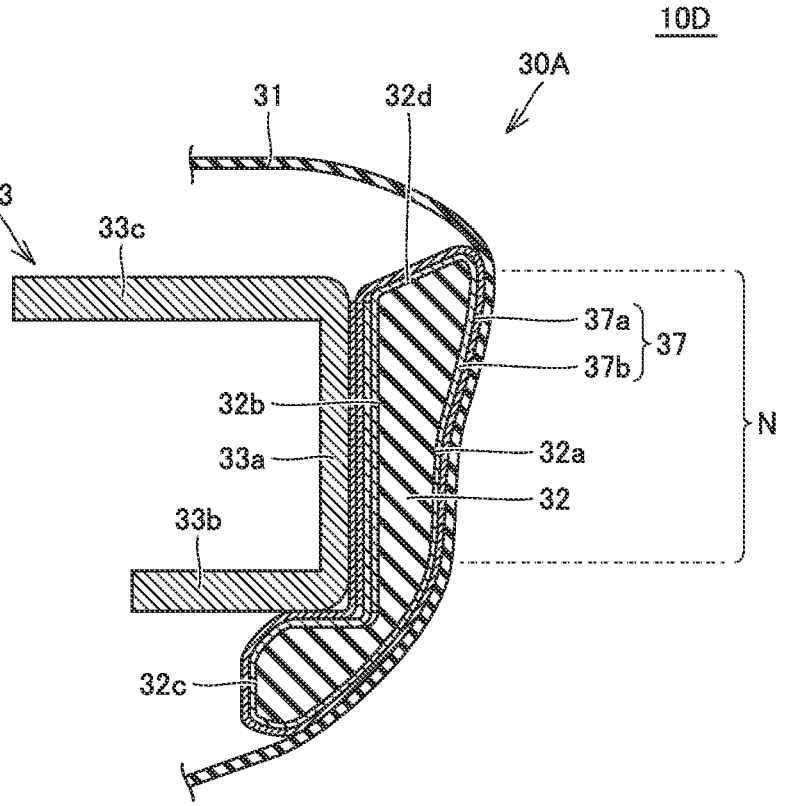
FIG. 8 is a sectional view illustrating a detailed structure near a pressure pad of a fixing device according to the fourth embodiment.

FIG. 8 is a sectional view illustrating a detailed structure near a pressure pad of a fixing device according to the fourth embodiment. With reference to FIG. 8, a fixing device 10D of the fourth embodiment will be described below. Instead of fixing device 10A of the first embodiment, fixing device 10D of the fourth embodiment is included in image forming apparatus 1.

As illustrated in FIG. 8, in fixing device 10D of the fourth embodiment, laminated sheet 37 includes sliding contact sheet 37*a* and heat insulating sheet 37*b*, and is located so as to surround pressure pad 32.

More specifically, each of sliding contact sheet 37*a* and heat insulating sheet 37*b* includes the portion covering first main surface 32*a*, second main surface 32*b*, third main surface 32*c*, and fourth main surface 32*d* of pressure pad 32. Heat insulating sheet 37*b* is interposed between sliding contact sheet 37*a* and pressure pad 32, and a front surface and a back surface of heat insulating sheet 37*b* contact with sliding contact sheet 37*a* and pressure pad 32, respectively.

With this configuration, in fixing device 10D of the fourth embodiment, heat insulating sheet 37*b* is interposed between sliding contact sheet 37*a* and pressure pad 32 and between pressure pad 32 in the portion in which sliding contact sheet 37*a* slides on the inner peripheral surface of fixing belt 31 and support member 33 in a plurality of interfaces located between sliding contact sheet 37*a* in the portion in which sliding contact sheet 37*a* slides on the inner peripheral surface of fixing belt 31 and support member 33. Consequently, the transfer of the heat of fixing belt 31 to pressure pad 32 and support member 33 can effectively be prevented by heat insulating sheet 37*b* disposed in the portion.

Thus, in fixing device 10D of the fourth embodiment and image forming apparatus 1 including fixing device 10D, the transfer of the heat of fixing belt 31 to pressure pad 32 and support member 33 can effectively be prevented, and the energy saving can be further achieved than before.

Fifth Embodiment

Figure 9:
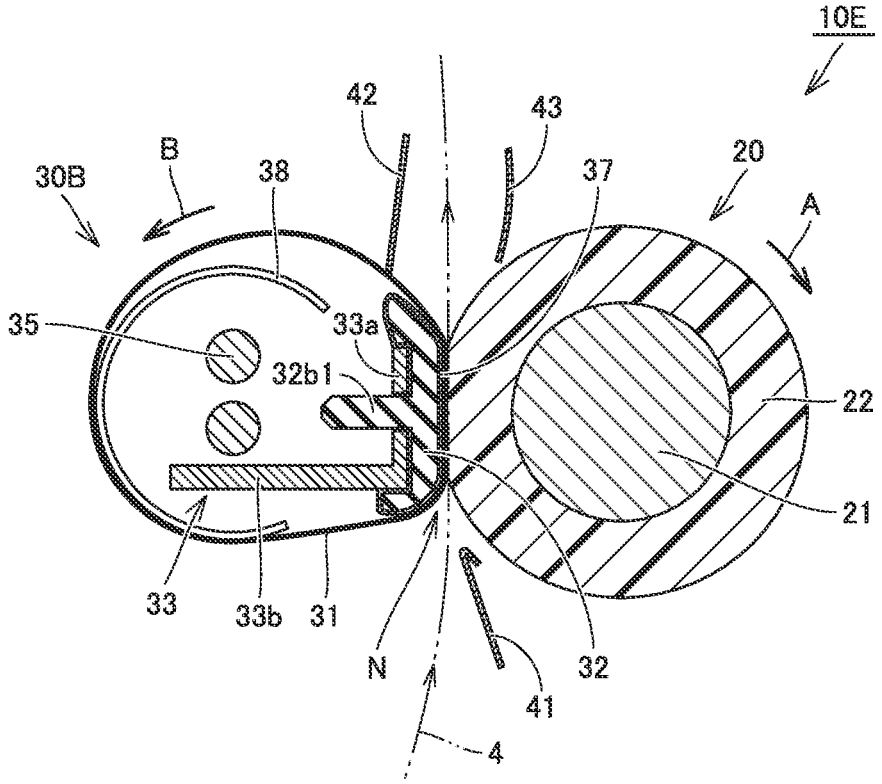
FIG. 9 is a schematic sectional view illustrating a fixing device according to a fifth embodiment.

FIG. 9 is a schematic sectional view illustrating a fixing device according to a fifth embodiment. With reference to FIG. 9, a fixing device 10E of the fifth embodiment will be described below. Instead of fixing device 10A of the first embodiment, fixing device 10E of the fifth embodiment is included in image forming apparatus 1.

As illustrated in FIG. 9, instead of fixing belt unit 30A of the first embodiment, fixing device 10E includes a fixing belt unit 30B mainly including fixing belt 31, pressure pad 32 as the pad member, support member 33, heat source 35, and a pair of belt guides 38. In fixing belt unit 30B, the installation of heating roller 34 is mainly omitted in fixing belt unit 30A of the first embodiment.

Pressure pad 32 is located so as to be opposed to pressure roller 20, and disposed inside fixing belt 31. Support member 33 supports pressure pad 32, and is disposed inside fixing belt 31. Heat source 35 is disposed in the space inside fixing belt 31, and directly heats fixing belt 31.

Support member 33 has a substantially L-shaped section including flat base 33*a* opposed to pressure pad 32 and upstream-side standing wall 33*b* provided upright from base 33*a* at the upstream position in the conveyance direction of sheet S.

The pair of belt guides 38 is provided at positions corresponding to both ends in the axial direction of pressure roller 20 in the space inside fixing belt 31. The pair of belt guides 38 has a substantially C-shaped section, and fixing belt 31 is slidably entrained around the outer peripheral surfaces of the pair of belt guides 38. The pair of belt guides 38 is fixed to a chassis (not illustrated), thereby guiding the movement of fixing belt 31.

Although the detailed description will be omitted, even in fixing device 10E of the fifth embodiment, similarly to fixing device 10A of the first embodiment, laminated sheet 37 is attached to the surface of pressure pad 32, and heat insulating sheet 37*b* as the heat insulating member included in laminated sheet 37 is interposed between sliding contact sheet 37*a* in the portion in which sliding contact sheet 37*a* slides on the inner peripheral surface of fixing belt 31 and pressure pad 32 (see FIGS. 3 and 4).

Even in fixing device 10E having the above configuration and image forming apparatus 1 including fixing device 10E, the same effect as that of the first embodiment can be obtained. Thus, the fixing device and the image forming apparatus including the fixing device can be provided in which the transfer of the heat of fixing belt 31 to pressure pad 32 and support member 33 can effectively be prevented, and the energy saving can be further achieved than before.

(Summary of Contents Disclosed in the Embodiments and its Modification)

The contents disclosed in the first to fifth embodiments and the modifications are summarized as follows.

The fixing device fixes the toner image formed on a recording material to the recording material, and includes a fixing belt, a heat source, a pad member, a pressure rotating body, a sliding contact member, and support member. The fixing belt is an endless fixing belt, and the heat source is configured to heat the fixing belt. The pad member is disposed so as to be opposed to an inner peripheral surface of the fixing belt, and the pressure rotating body is disposed so as to be opposed to an outer peripheral surface of the fixing belt. The pressure rotating body is rotated while the fixing belt is pressed against the pad member, so that the pressure rotating body forms a nip in which the recording material is conveyed between the outer peripheral surface of the fixing belt and the pressure rotating body while driving the fixing belt to rotate. In the sliding contact member, at least a part of the sliding contact member is disposed between the fixing belt and the pad member such that the sliding contact member slides on the inner peripheral surface of the fixing belt in a portion corresponding to the nip. The support member supports the pad member. In the fixing device, a heat insulating member having thermal conductivity lower than thermal conductivity of the pad member is interposed in at least one of a plurality of interfaces located between the sliding contact member in a portion in which the sliding contact member slides on the inner peripheral surface of the fixing belt and the support member.

In the fixing device, the heat insulating member may be interposed between the sliding contact member in a portion in which the heat insulating member slides on an inner peripheral surface of the fixing belt and the pad member.

In the fixing device, the heat insulating member may be interposed between the pad member and the support member.

In the fixing device, the heat insulating member preferably has thermal conductivity lower than thermal conductivity of the sliding contact member.

In the fixing device, the heat insulating member is preferably made of a member that can freely be deformed by receiving an external pressure.

In the fixing device, the heat insulating member may be formed of a sheet-like member made of a fiber material.

In the fixing device, the heat insulating member may be made of a woven or nonwoven fabric of a glass fiber.

An image forming apparatus includes the fixing device in order to form an image.

(Other Forms)

The characteristic configurations illustrated in the first to fifth embodiments and the modifications can be mutually combined with each other without departing from the gist of the present invention.

In the first to fifth embodiments and the modifications, by way of example, the present invention is applied to a so-called tandem-type color printer in which the electrophotographic system is adopted and the fixing device included in the tandem-type color printer. However, the application of the present invention is not limited to this configuration, and the present invention can be applied to various image forming apparatuses in which the electrophotographic system is adopted and fixing devices included in the image forming apparatuses.

Although embodiments of the present invention have been described and illustrated in detail, the disclosed embodiments are made for purposes of illustration and example only and not limitation. The scope of the present invention should be interpreted by terms of the appended claims

What is claimed is:

1. A fixing device that fixes a toner image formed on a recording material to the recording material, the fixing device comprising:

an endless fixing belt;

a heat source configured to heat the fixing belt;

a pad member disposed so as to be opposed to an inner peripheral surface of the fixing belt;

a pressure rotating body disposed so as to be opposed to an outer peripheral surface of the fixing belt, the pressure rotating body being rotated while the fixing belt is pressed against the pad member, so that the pressure rotating body forms a nip in which the recording material is conveyed between the outer peripheral surface of the fixing belt and the pressure rotating body while driving the fixing belt to rotate;

a sliding contact member in which at least a part of the sliding contact member is disposed between the fixing belt and the pad member such that the sliding contact member slides on the inner peripheral surface of the fixing belt in a portion corresponding to the nip; and a support member supporting the pad member, wherein a heat insulating member having thermal conductivity lower than thermal conductivity of the pad member is interposed in at least one of a plurality of interfaces located between the sliding contact member in a portion in which the sliding contact member slides on the inner peripheral surface of the fixing belt and the support member.

2. The fixing device according to claim 1, wherein the heat insulating member is interposed between the sliding contact member in a portion in which the sliding contact member slides on an inner peripheral surface of the fixing belt and the pad member.

3. The fixing device according to claim 1, wherein the heat insulating member is interposed between the pad member and the support member.

4. The fixing device according to claim 1, wherein the heat insulating member has a thermal conductivity lower than thermal conductivity of the sliding contact member.

5. The fixing device according to claim 1, wherein the heat insulating member is a member that can freely be deformed by receiving an external pressure.

6. The fixing device according to claim 1, wherein the heat insulating member is formed of a sheet-shaped member made of a fiber material.

7. The fixing device according to claim 6, wherein the heat insulating member is made of a woven or nonwoven fabric of a glass fiber.

8. An image forming apparatus comprising the fixing device according to claim 1 in order to form an image.

* * * * *